United States Patent [19]

Drake

[11] Patent Number: 4,721,301

[45] Date of Patent: Jan. 26, 1988

[54] EXERCISE MACHINE

[75] Inventor: Thomas P. Drake, Orangeville, Canada

[73] Assignee: Calar Home Products Limited, Orangeville, Canada

[21] Appl. No.: 896,051

[22] Filed: Aug. 13, 1986

[51] Int. Cl.[4] ..... A63B 21/06

[52] U.S. Cl. ..... 272/118

[58] Field of Search ..... 272/117, 118, 134, 136, 272/142

[56] References Cited

U.S. PATENT DOCUMENTS 4,154,441 5/1979 Gajda ..... 272/118
4,549,733 10/1985 Salyer ..... 272/118
4,632,388 12/1986 Schleffendorf ..... 272/118
4,634,118 1/1987 Jensen ..... 272/134 X
4,634,127 1/1987 Rockwell ..... 272/118 X

FOREIGN PATENT DOCUMENTS 3205581 8/1983 Fed. Rep. of Germany ..... 272/117

*Primary Examiner*—Richard J. Apley
*Assistant Examiner*—Robert W. Bahr
*Attorney, Agent, or Firm*—Ivor M. Hughes

[57] ABSTRACT

An exercise machine comprising a frame for supporting the vertical lifting of a stack of weights. The stack of weights are connected to a cable which passes through a pulley for multiplying the amount of force necessary to lift the stack of weights when a person using the exercise machine pulls on the end of a cable remote the stack of weights. The mass of the weights necessary for lifting in order to achieve the same force to be exerted by a person is thereby reduced.

2 Claims, 6 Drawing Figures

EXERCISE MACHINE

FIELD OF INVENTION

This invention relates to an exercise machine employing a frame for supporting the lifting of weights.

BACKGROUND OF INVENTION

A variety of exercise machines in common use employ a cage or frame for supporting the vertical movement or lifting of a stack of weights. Usually the frame supports one or more vertically extending shafts or quide wires which pass through a plurality of aligned apertures in a stack of weights. Means attached to a cable for lifting the weights may be grasped at one end by a person using the exercise machine. The opposite end of the cable is attached to the stack of weights by removable means so that the number of weights in a stack to be lifted may 5 be selected. In a typical structure, the cable is attached to a shaft extending vertically which slides into a plurality of vertically aligned apertures in the stack of weights. The shaft has a plurality of spaced apertures extending transversely therethrough. Each of the weights has a hole extending transversely into the vertical aperture which receives the shaft, whereby a pin may be inserted through a hole in a weight into an aligned aperture in the shaft. Through the insertion of the pin through a transversely extending hole in one of the weights in the stack of weights and an aperture in the shaft aligned therewith, the number of weights in the stack of weights attached to the cable for lifting may be selected. In exercise machines in use presently, the amount of force exerted by a person using the exercise machine is approximately equal to the weight of the stack of weights being lifted. It will be appreciated by those skilled in the art that the vertical movement or lifting of a stack of weights by a cable for lifting the weights supported within the frame bears the risk of the weights falling. Furthermore, the weights add to the effort and expense associated with transporting the exercise It is therefore an object of this invention to provide an exercise machine comprising means for lifting a stack of weights which is safer to use than exercise machines in use heretofor, and is cheaper to manufacture and transport, requiring the use of less weights. Further . and other objects of the invention will be apparent to those skilled in the art from the following summary of the invention and detailed description thereof.

SUMMARY OF INVENTION

According to one aspect of the invention there is provided an exercise machine comprising in combination (a) a frmae for supporting the vertical lifting of a weight, (b) a weight secured in said frame for vertical lifting, (c) first flexible cable means attached at one end to the weight, and attached at the other end to pulley means for multiplying the force necessary for equilibrium with the weight, and (d) second flexible cable means attached at one end to the pulley means for multiplying the force necessary for equilibrium and attached at the other end to means that may be grasped by a person using the exercise machine for lifting the weight.

According to a preferred embodiment of the invention, there is provided an exercise machine comprising in combination (a) a frame for supporting the vertical lifting of a stack of weights, (b) a stack of weights secured in said frame for vertical lifting, (c) first flexible cable means attached at one end to the stack of weights, and attached at the other end to pulley means for multiplying the amount of force necessary for equilibrium with the stack of weights, and (d) second flexible cable means attached at one end to the pulley means for multiplying the force necessary for equilibrium and attached at the other end to means that may be grasped by a person using the exercise machine for lifting the stack of weights. The invention will now be illustrated with reference to the following drawings of an embodiment of the invention.

BRIEF DESCRIPTION OF THE THE DRAWINGS

DETAILED DESCRIPTION OF THE EMBODIMENTS

Figure 1:
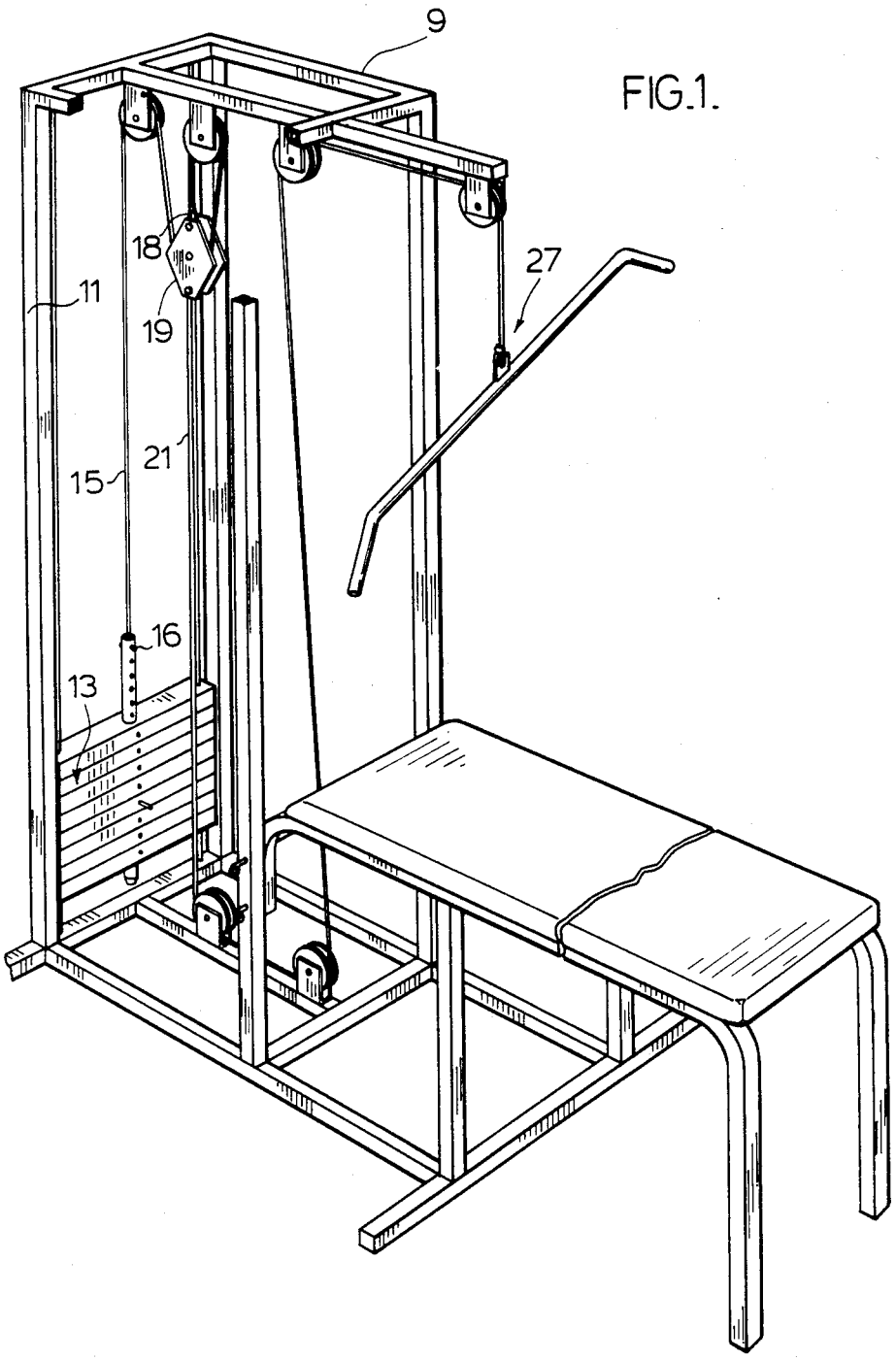
FIG. 1 is a perspective view of an exercise machine.
Figure 2:
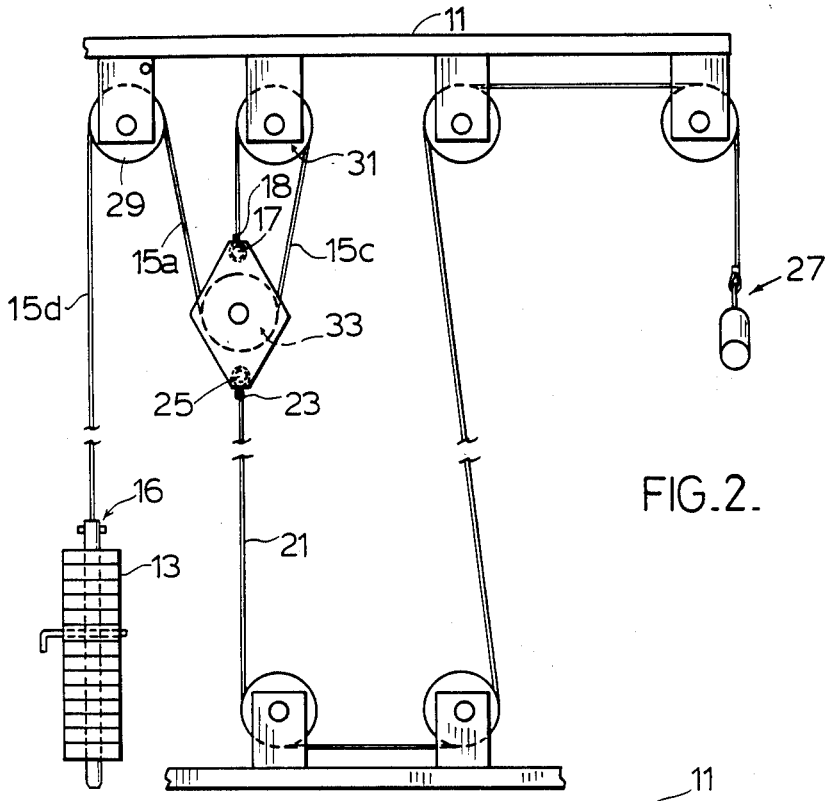
FIG. 2 is a side view of a portion of the exercise machine in FIG. 1, in a resting position.
Figure 3:
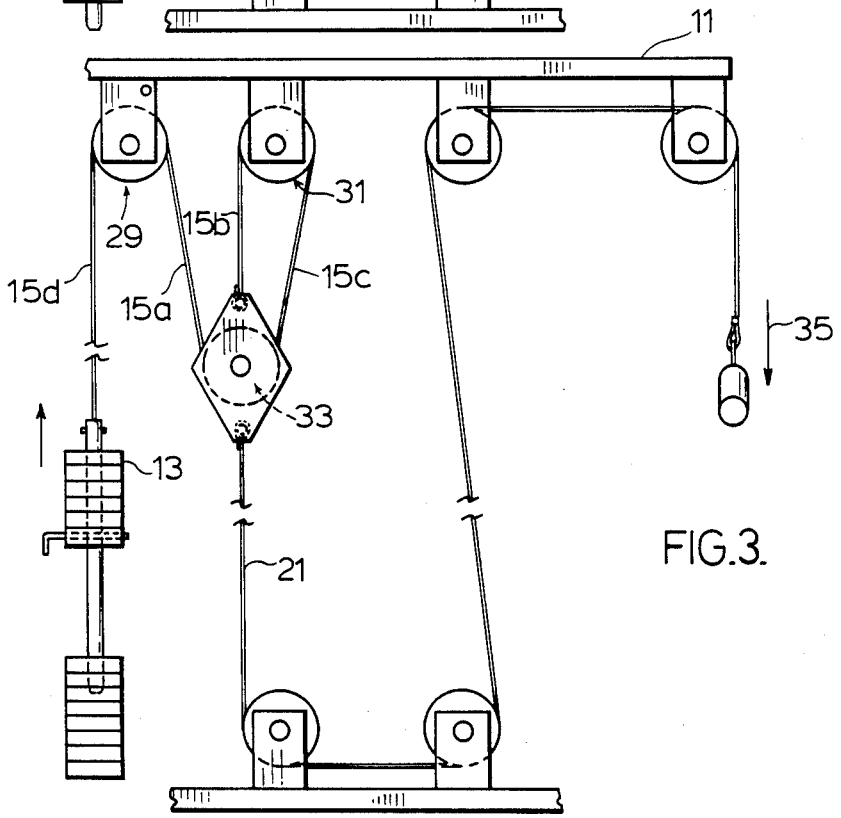
FIG. 3 is a view of the exercise machine in FIG. 2, in a lifting position.
Figure 6:
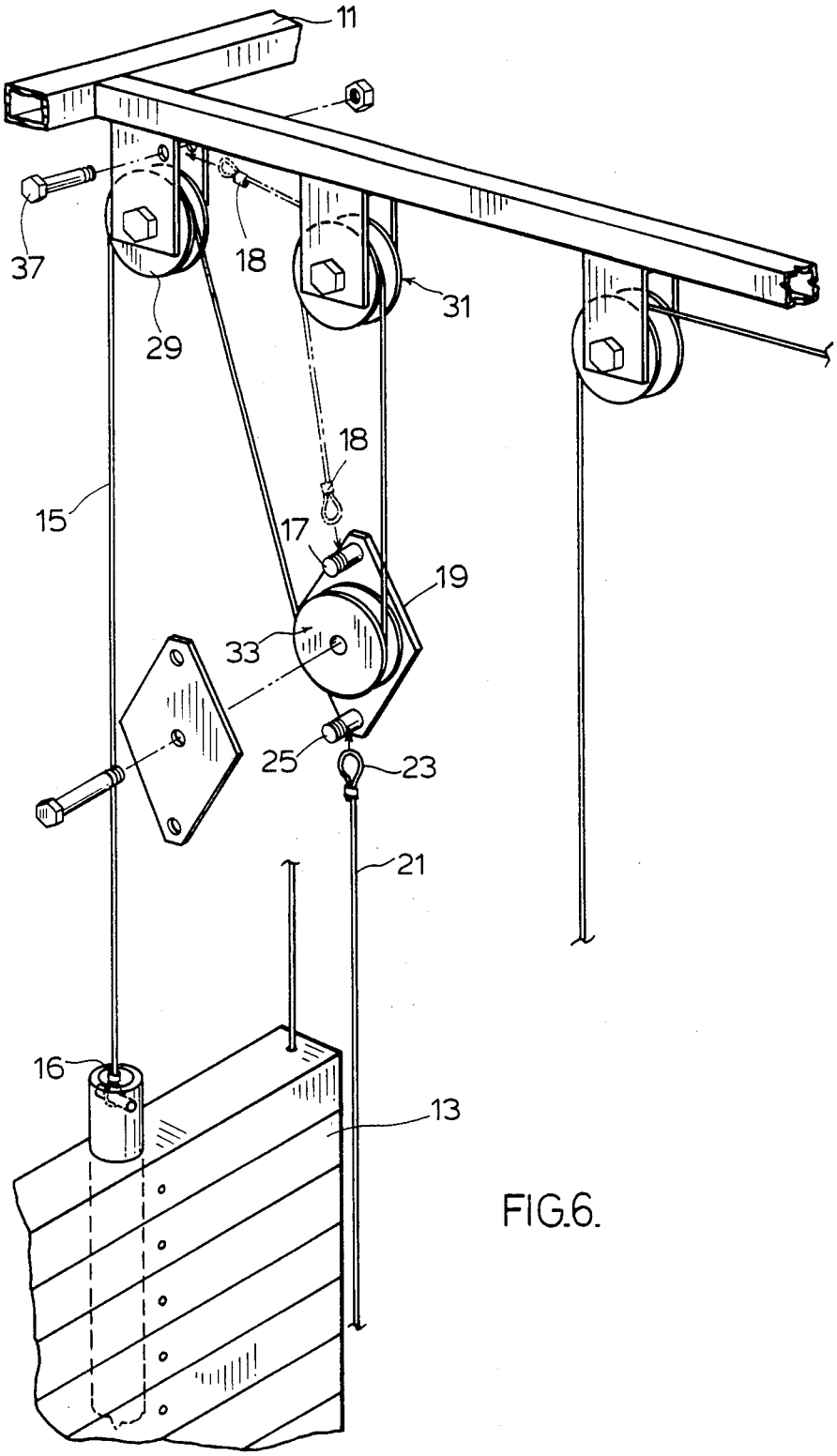
FIG. 6 is a close-up view of adjustment means to provide two different mechanical advantages.

With reference to FIG. 1, 2, and 6, there is shown an exercise machine 9 having a frame 11 for supporting the vertical movement of a stack of weights 13. Cable 15 is attached at one end 16 to the stack of weights 13 and at the other end 18 to a pin 17 (best seen in FIG. 6) affixed to a pulley housing 19. A second cable 21 is attached at one end 23 to pin 25, which is affixed to pulley housing 19. Cable 21 may be grasped at the other end 27 by a person using the exercise machine. With reference to FIGS. 2 and 3, Cable 15 threads its way through movable wheels 29, 31, 33, which in combination with pulley housing 19 and cable 21 comprises pulley means for multiplying the force 35 (best seen in FIG. 3) necessary for equilibrium with the stack of weights 13. Since the weight supported by each of elements 15*a*, 15*b*, 15*c* of the cable is equal to the weight supported by element 15*d*, the force 35 necessary to lift the stack of weights 13 is multiplied by a factor of three.

Figure 4:
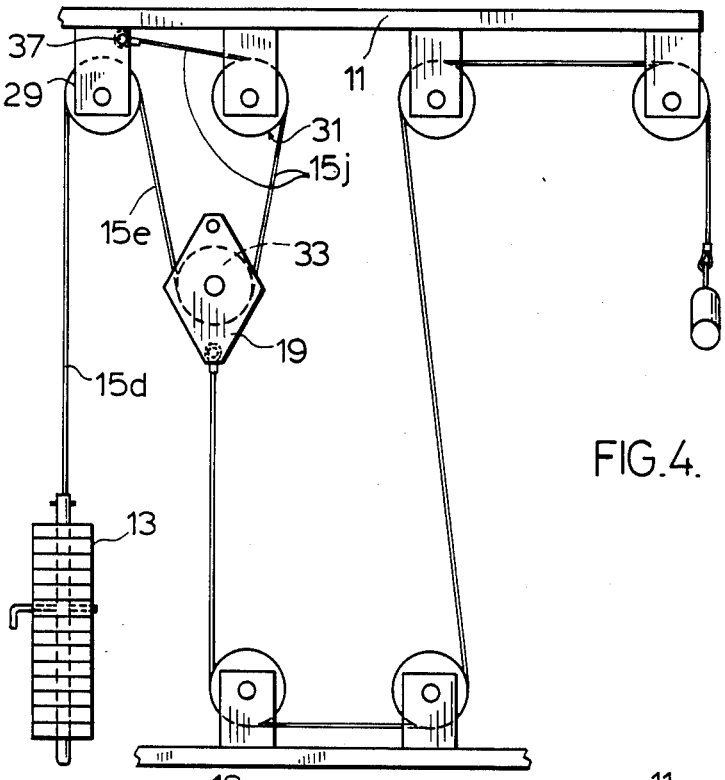
FIG. 4 is a side view of a portion of the exercise machine in FIG. 1, in a resting position, adjusted to provide a different mechanical advantage to that depicted in FIGS. 2 and 3.
Figure 5:
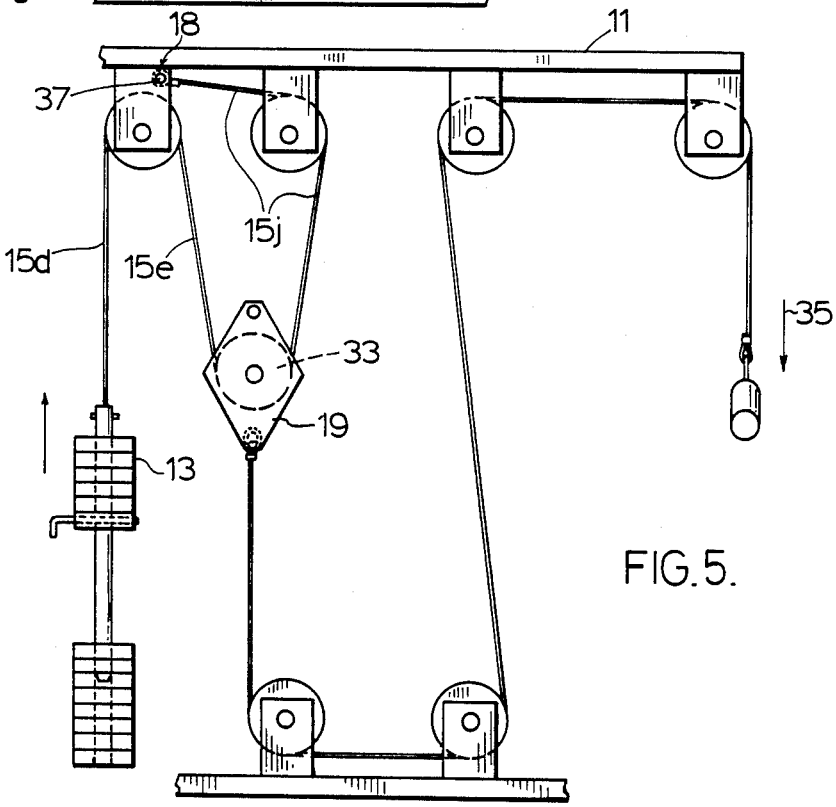
FIG. 5 is a view of the exercise machine in FIG. 4, in a lifting position.

With reference to FIGS. 4, 5, and 6, in another embodiment of the invention, cable end 18 may be attached to frame 11 by pin 37, so as to provide collinear element 15*c*. The mechanical advantage of the pulley means for multiplying the force 35 necessary for equilibrium with the stack of weights 13 is thereby changed. Since the weight supported by each of the elements 15*e* and 15*j* (best seen in FIGS. 4 and 5) is equal to the weight supported by element 15*d*, the force 35 necessary to lift the stack of weights 13, is multiplied by a factor of two.

As many changes can be made to the embodiment of the invention without departing from the scope of the invention, it is intended that all material be considered as illustrative of the invention and not in a limiting sense.

The embodiments of the invention in which an exclusive property or privilege is claimed are as follows:

1. An exercise machine comprising in combination:

(a) a fixed frame for supporting the vertical lifting of a movable weight, (b) a movable weight supported in said frame for vertical lifting, (c) first cable means attached at a first end ot the movable weight, (d) a first pulley and fixed block therefor attached to the frame at a position spaced vertically above the movable weight, the first pulley receiving the first cable means;

(e) a second pulley and movable block therefor, the movable block mounted at an uppermost portion to a second end remote the first end of the first cable means and mounted at a lowermost portion to a first end of second cable means, the second pulley receiving the first cable means;

(f) a third pulley and fixed block therefor attached to the frame at a position spaced vertically above the movable weight, the third pulley receiving the portion of the first cable means intermediate the portion thereof received by the second pulley and the second end of the first cable means;

(g) second cable means attached at a first end to the lowermost portion of the movable block of the second pulley;

(h) at least a fourth pulley and fixed block therefor attached to the frame at a position spaced vertically below the first fixed pulley and third fixed pulley, the fourth pulley receiving the second cable means (i) handle means attached to a second end of the second cable means, suitable for grasping by a person applying force to the handle means for lifting the movable weight whereby the amount of force applied by a person grasping the handle means necessary for lifting the weight is multiplied by a factor of about three (3).

2. An exercise machine comprising in combination:

(a) a fixed frame for supporting the vertical lifting of a movable weight;

(b) a movable weight supported in said frame for vertical lifting;

(c) first cable means attached at a first end to the movable weight;

(d) a first pulley and fixed block therefor attached to the frame at a position spaced vertically above the movable weight, the first pulley receiving the first cable means;

(e) a second pulley and movable block therefor, the movable block mounted solely at a lowermost portion to a first end of second cable means, the second pulley receiving the first cable means;

(f) a third pulley and fixed block therefor attached to the frame at a position spaced vertically above the movable weight, the third pulley receiving the portion of the first cable means of (c) intermediate the portion thereof received by the second pulley and the second end of the first cable means;

(g) a second end of the first cable means attached to the frame at a position about intermediate the first fixed pulley and the third fixed pulley;

(h) second cable means attached at a first end to the lowermost portion of the movable block of the second pulley;

(i) at least a fourth pulley and fixed block therefor attached to the frame at a position spaced vertically below the first fixed pulley and third fixed pulley; the fourth pulley receiving the second cable means;

(j) handle means attached to a second end of the second cable means, suitable for grasping by a person applying force to the handle means for lifting the movable weight; whereby the amount of force applied by a person grasping the handle means necessary for lifting the weight is multiplied by a factor of about two (2).

* * * * *